US009091137B2

(12) United States Patent
Pettersen et al.

(10) Patent No.: US 9,091,137 B2
(45) Date of Patent: Jul. 28, 2015

(54) METHOD AND SYSTEM FOR PERFORMING WELL OPERATIONS

(75) Inventors: Arnt Ove Pettersen, Kongsberg (NO); Antony D. Muff, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 151 days.

(21) Appl. No.: 13/814,494

(22) PCT Filed: Aug. 1, 2011

(86) PCT No.: PCT/EP2011/063209

§ 371 (c)(1),
(2), (4) Date: Apr. 22, 2013

(87) PCT Pub. No.: WO2012/016947

PCT Pub. Date: Feb. 9, 2012

(65) Prior Publication Data

US 2013/0206418 A1 Aug. 15, 2013

(30) Foreign Application Priority Data

Aug. 6, 2010 (NO) ..... 20101116

(51) Int. Cl.

| | |
|---|---|
| ***E21B 17/01*** | (2006.01) |
| ***E21B 33/038*** | (2006.01) |
| ***E21B 33/076*** | (2006.01) |
| ***E21B 19/00*** | (2006.01) |
| ***E21B 33/035*** | (2006.01) |

(52) U.S. Cl.

CPC ..... *E21B 33/076* (2013.01); *E21B 17/01* (2013.01); *E21B 19/004* (2013.01); *E21B 33/035* (2013.01); *E21B 33/038* (2013.01)

(58) Field of Classification Search

CPC ..... E21B 17/01; E21B 19/004; E21B 33/038; E21B 33/076; E21B 19/006

USPC ..... 166/345, 349, 352, 367; 405/224.2, 405/224.4

See application file for complete search history.

(56) References Cited

U.S. PATENT DOCUMENTS

| | | | | |
|---|---|---|---|---|
| 7,926,593 | B2 * | 4/2011 | Bailey et al. | 175/87 |
| 8,127,854 | B2 * | 3/2012 | Haheim | 166/367 |
| 2006/0219411 | A1 * | 10/2006 | Moksvold | 166/345 |
| 2009/0260831 | A1 * | 10/2009 | Moksvold | 166/350 |
| 2012/0091705 | A1 * | 4/2012 | Reinas et al. | 285/223 |

FOREIGN PATENT DOCUMENTS

| | | | |
|---|---|---|---|
| GB | 2 358 032 | A | 7/2001 |
| WO | WO 2004/044367 | A2 | 5/2004 |
| WO | WO 2005/100737 | A1 | 10/2005 |
| WO | WO 2006/096069 | A1 | 9/2006 |
| WO | WO 2009/061211 | A2 | 5/2009 |
| WO | WO 2010125031 | A1 * | 11/2010 |

* cited by examiner

*Primary Examiner* — Matthew Buck

(57) ABSTRACT

The present invention relates to a method for performing well operations from a floating installation comprising a high pressure riser (8) connected to the floating installation through a tension system, and where the riser comprises a housing (18) with an internal diameter larger than an internal diameter of the riser and connected at the top of the riser, where it for performing operations is made an assembly (15) comprising a desired numbers of modules for use in a specific operation, the modules are assembled at the installation, then positioned in the housing and the operation is performed through the assembly.

9 Claims, 15 Drawing Sheets

METHOD AND SYSTEM FOR PERFORMING WELL OPERATIONS

BACKGROUND OF THE INVENTION

The present invention relates to a method and system for performing well operations from a floating installation.

Normally a conventional rig up for performing operations in a well will be comprised of stacked up heave eliminators, which comprises means for keeping the tension in a riser with the movement of a floating vessel or a floating installation, surface flow tree (SFT), equipment for performing wire line or coiled tubing operations into the well or even drilling in the well as for instance through tubing drilling, and a surface blow out preventer (SBOP) on the rig floor as part of the conventional work over riser. There will in some instances also be arranged a telescopic element in the riser below the SBOP. For performing wire line or coiled tubing operations the riser string will normally be depressurized and the rig heave motions vs. the workover riser string are compensated by keeping the upper end of the riser string with the SBOP in relative position in relation to the vessel.

There is in the applicant's own Norwegian patent application No. 20075757 (from which a applicant's pending U.S. patent application Ser. No. 12/734,562 claims priority) described a system where the difficulties with using a pressurized telescopic joint in a high pressure riser and also the situation with having the SBOP located on the top of the riser above the telescopic joint, creating outlets for well fluids at high pressure at a deck creating a situation which is possibly hazardous for personnel working on the floating installation, is solved by positioning an upper workover riser package (UWRP), with means for closing off the passage in the riser and means for cutting any equipment extending down in to the riser, is arranged below a telescopic joint in the riser. The UWRP is thereby arranged to be in a fixed position relative the seabed. The riser is kept in tension by the tensioning system on the floating installation. As the UWRP may be regarded as an extension of the riser, the tension wires are connected to the top of the UWRP to avoid bending forces acting on the UWRP. The system in NO2007575 further describes a system where the UWRP comprises an interface for connection of different kind of workover equipment, such as equipment for performing coiled tubing operations or equipment for wire line operations.

One problem with this system is the need to have the UWRP configured to close the passage and shear equipment that may be present in the passage, resulting in the need to equip the UWRP with several kinds of equipment for the different activities to be performed in the well. Another element is that the valves and shearing functionalities within the UWPR sometimes needs to be replaced or repaired, then the whole riser configurations must be released and taken up on the floating installation.

SUMMARY OF THE INVENTION

An aim with the present invention is to provide a method and system for performing operations in a high pressure riser which gives more flexibility than this known system.

This is achieved with a system as defined in the attached independent method and system claims, with further details and embodiments given in the dependent claims and description below.

According to the invention there is provided a method for performing well operations from a floating installation comprising a high pressure riser connected to the floating installation through a tension system. The riser is connected to a subsea well or installation on the seabed and should be kept in tension to not damage the installation on the seabed. The floating installation may be a floating vessel, floating platform or other floating unit, which would be influenced by wave and weather conditions and also possibly currents in the water etc. The riser according to the invention comprises a housing with an internal diameter larger than an internal diameter of the riser element and the housing is connected at the top of the riser element, wherein the housing is formed with a first connection interface. The housing will normally be kept in a fixed position relative the seabed and the tension system on the floating vessel would normally be connected to an upper part of the housing. According to the invention there is for performing operations made an assembly, having a second connection interface, and wherein the assembly comprises a desired numbers of modules for use in a specific operation, the modules are assembled at the installation, then positioned in the housing. The second connection interface in the assembly is connected to the first connection interface in the housing. The operation is performed through the assembly. The modules will comprise modules for closing the passages of the riser, modules for shearing elements extending in to the riser and also tool specific modules, as for instance modules for closing the passage in the riser around a wire line or coiled tubing, modules for shearing a wire line, and modules for shearing coiled tubing. There may also be extension modules, and control module modules in the assembly. This gives the possibility of adapting equipment for the specific work to be performed in the well. This gives larger flexibility at location for performing the operation as the system is assembled by modules at the installation. Another benefit is since the equipment is operation specific; the load on the riser is kept at a minimum as there for instance will be shearing functionality for a wire line and not a coiled tubing when performing wire line operations. The module functionality may also give the benefit of having the possibility of preparing a new assembly while another is still in use, or replacing some of the modules in an assembly with spare modules when the first ones needs to be repaired or maintained.

According to the invention the method may comprise the step, wherein the assembly of modules is made up of two or more subassemblies, whereof each comprises at least two modules, to position the subassemblies separately in relation to the housing. This gives the possibility of attaching one subassembly within the housing and to the riser which could be used with different other subassemblies, which then could be attached to the one subassembly and thereafter replaced with a different subassembly. Another possibility is to have the whole assembly attached to the riser in one operation. In yet another possibility one may have a subassembly which comprises only one module.

According to another aspect the method may comprise the assembly to be pressure tested at the installation before positioned in the housing or attaching to the riser. This pressure testing may be performed of the whole assembly or one may pressure test subassemblies separately.

According to the invention there is also provided a riser system for performing operations in a well. This riser system comprises a high pressure riser extending from a subsea installation up to and connected to a floating installation through a tension system at a tension connection point. There is at top of the riser arranged a housing. According to the invention the housing is forming part of said riser and is formed with a first connection interface. The housing may also be incorporated as a part of the riser. There is to the connection interface connected an assembly comprising at least two modules, wherein the assembly has a second connection interface for connection of the assembly to the housing through the first connection interface. This assembly would comprise modules with different functionalities needed for the specific operations to be performed in the well.

This riser system gives the possibility of having the assembly specially adapted to the different kinds of operations to the performed in the well with the increased flexibility and benefits this gives.

According to an aspect the assembly, with at least two modules, may comprise a first subassembly comprising at least one modular element and an interface for cooperation with the connection interface of the housing, and a second subassembly for performing the operation in the well, comprising an attachment interface for cooperation with the attachment interface of the first subassembly. The subassemblies may comprise one or more modules each, different numbers of modules, and there may also be more than two subassemblies. A configuration with a subassembly may also be called a split insert BOP.

According to another aspect the internal diameter of the housing is larger than an internal diameter of the riser and adapted to encompass at least a part of the assembly. The housing will be a non-pressure containing housing. The housing can then be made as a relatively thin walled element, compared with the UWRP in the applicant's earlier application. The housing will be formed with the connection interface within the housing and at least a part of the connection interface at a lower part of the housing. The housing will protect the assemblies to be connected to the riser system from the environment. The housing would also be guide for the assembly to be connected to the connection interface in the housing. The housing would in one embodiment also comprise means, i.e. a connection point for connection of the riser system to the tension system at the floating installation. Such a connection point may be positioned at an uppermost part of the housing. The housing may also relatively be positioned within the water but by its configuration keeping the connection interface and also the first subassembly out of water. The housing may extend a distance in the length direction of the riser, from a position in the body of water to a position well above the water level. According to an embodiment the first subassembly may be encompassed by the housing. In another embodiment also part of a second subassembly may be encompassed by the housing.

According to another aspect the riser system may comprise equipment for assemblage of the different assemblies at the installation and a system for pressure testing the assemblies before connecting them to the housing. The riser system may also comprise lifting equipment at the installation for moving the assemblies to and from a deck at the installation and the housing. This gives the possibility of quickly change the assemblies in the riser system and thereby adapting it to different operations. The floating installation will have a set of modules for all different operations and when needed the different modules are assembled, using some of the same modules in the different assemblies. There is also the possibility of providing two modules of the same for the modules that are most frequently used, both to have a spare and also to assemble and test a new assembly while another one is used and removed from the riser system. This gives flexibility and saves time which is cost effective.

According to the invention there may be several modules to be assembled to form the assembly and or subassemblies.

In an embodiment the first subassembly might be a replaceable valve module assembly, and the second subassembly might be a replaceable tool assembly.

A module according to the invention comprises at least an interface, preferably two interfaces on opposite sides of the module, for connection to another module or the connection interface of the housing or an attachment interface for connection to another subassembly, means to allow it to be locked to another module or the housing, and means for sealing the connection between neighboring modules or the connection to the housing. The modules will possibly, dependent on the functionality of the module comprise means for transferring signals and power to elements within the module or through the module to other modules in the assemblies. Such transferring of signals and or power may be done within the modules in a direct line or as a multiplex system within one of the modules. Alternatively the transferring of signals and or power may be done from the outside and into the modules needing signal and or power. Such a system may be arranged outside the modules, possibly at the outside of the housing or possibly at least in part within the housing, and with means for transferring the signals and power through the wall of the housing and into the modules. Such a system may be a direct line system or a system with a multiplex system for at least some of the lines. There is also the possibility of providing the modules with means to orient the modules relative each other and also in relation to the housing, to for instance ensure that the signal and or power transmission is achieved in a correct manner. Activation of the functionality of the modules may be a system within the modules or be a system influencing the modules from the outside. The activation may be achieved by rotational movement, axial movement or radial movement or a combination. Communication for operation of the modules or communication transferred through the modules may be through physical lines as optical, acoustic, electrical, inductive or other means for transferring signals. The communication may also be wireless. A module may also be a control module module, to be positioned in any of the subassemblies or possibly at a position where it only will experience low pressures.

The modules need to be locked to each other to form a sealed connection, where at least some of the modules also should hold high pressure. Such a locking may be configured in several manners. There may be a locking system between each of the modules as such and a locking system for locking the lowermost module of the assembly to the interface of the housing. In an alternative embodiment the modules may be locked to each other by a system which locks several modules together and at the same time locks it to the housing, such a system may comprise locking means at one of the uppermost modules, or the uppermost of the high pressure modules. Such a locking system may then interact with the housing at the position of this module, and by activating this locking system several modules are locked and forming a sealing connection with each other.

In one embodiment the first subassembly, the valve module assembly or part of the assembly may comprise a first connection module, at least one valve module and a cutting module. In another embodiment the first connection module may comprise a valve. In a further embodiment the first connection module may be an extension joint module. In another embodiment the tool assembly may comprise a latch tool module, further the tool assembly may comprise a slip joint module. Alternatively or in addition the tool assembly may comprise a tool catcher module, an annular bag module and a dual stripper module. Alternatively or additionally the tool assembly may comprise a PCH, etc. All the different modules may be connected to form a single assembly or different subassemblies to be connected together to form the riser system.

There is in this description referred to upper and lower parts or elements, and this should be understood to be a part in normal configuration and use of the element in relation to a well operation.

BRIEF DESCRIPTION OF THE DRAWINGS

The invention will now be explained with reference to the attached drawings, where.

DETAILED DESCRIPTION OF THE INVENTION

Figure 1:
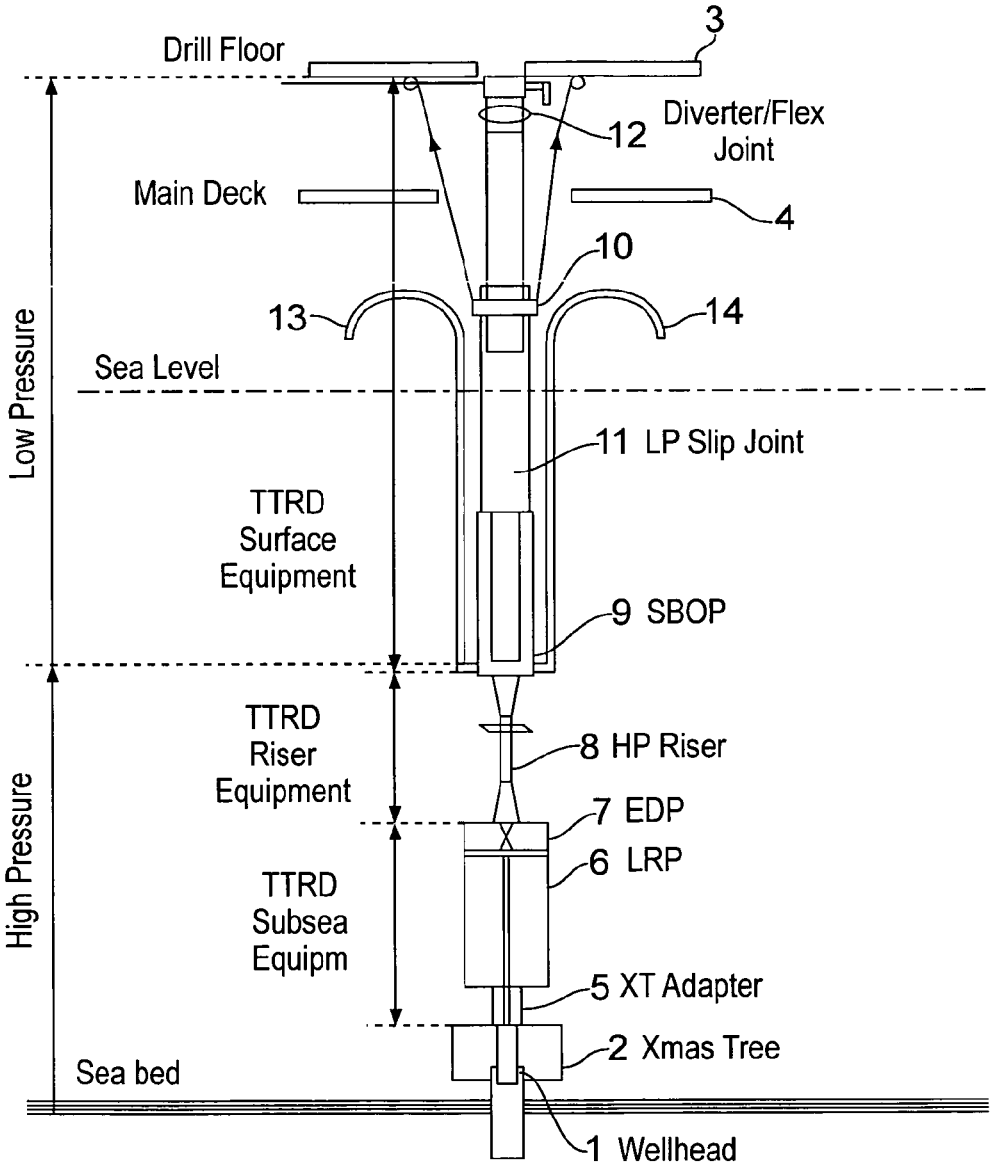
FIG. 1 shows an overall configuration of a high pressure riser extending from a subsea installation to a floating platform according to the invention.

In FIG. 1 there is shown an overall system sketch of a high pressure riser system extending between a subsea installation, in this case a wellhead 1 with a X-mas tree 2, and a floating installation, indicated with platform deck, a drill floor 3 and a main deck 4. A normal configuration of a high pressure riser system would comprise the X-mas tree 2, a X-mas tree adapter 5, a low riser package 6, an emergency disconnect package 7, a high pressure riser element 8, a SBOP (Surface Blow Out Preventer) 9, a connection point 10 for connection to tension equipment at the floating installation, a low pressure slip joint 11 and a diverter or flex joint 12. A configuration of a high pressure riser system may comprise all of these elements or only some of them and possibly also other element. There are also a kill line 13 and an injection line 14 connected to the riser system just below the SBOP 9.

Figure 2:
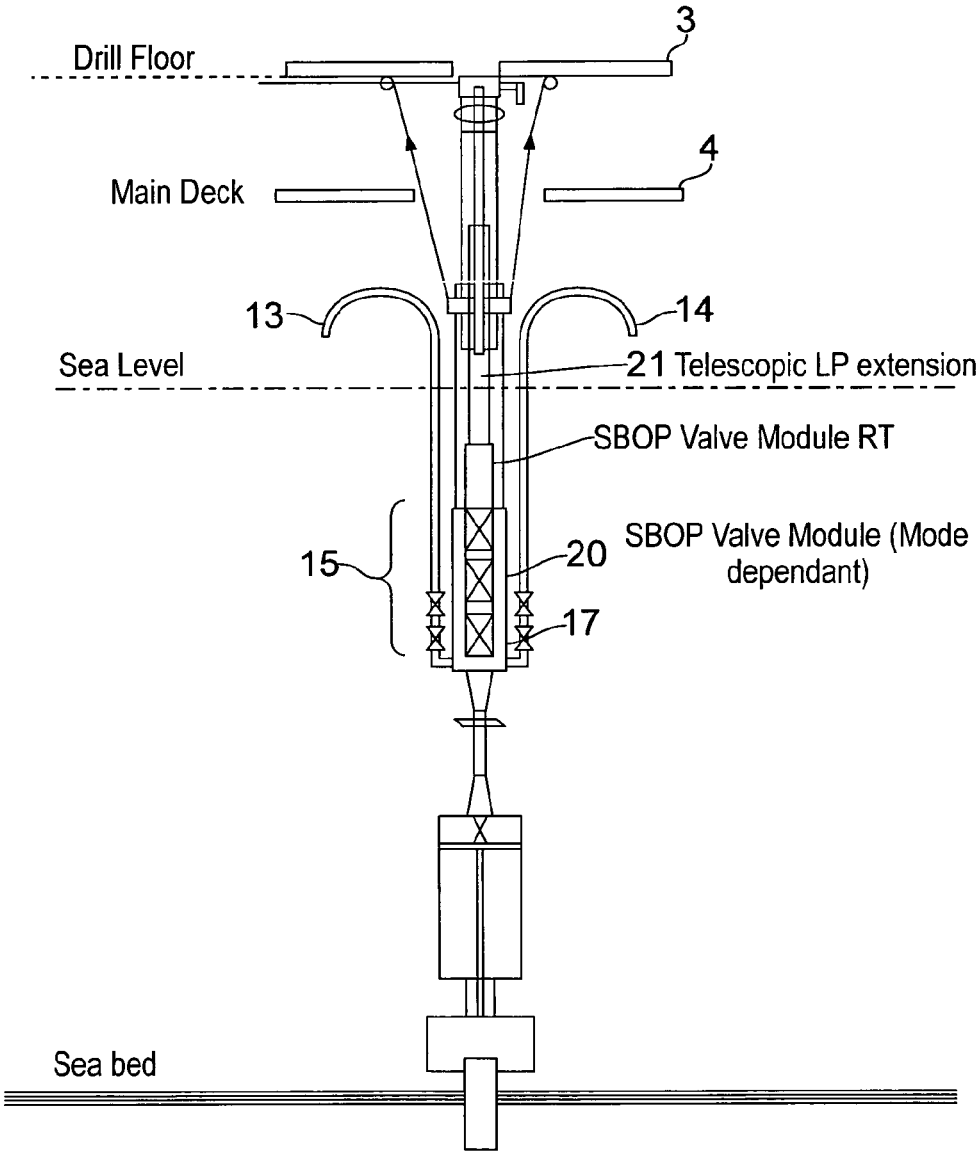
FIG. 2 is a schematic sketch of a system according to the invention in some more detail
Figure 3:
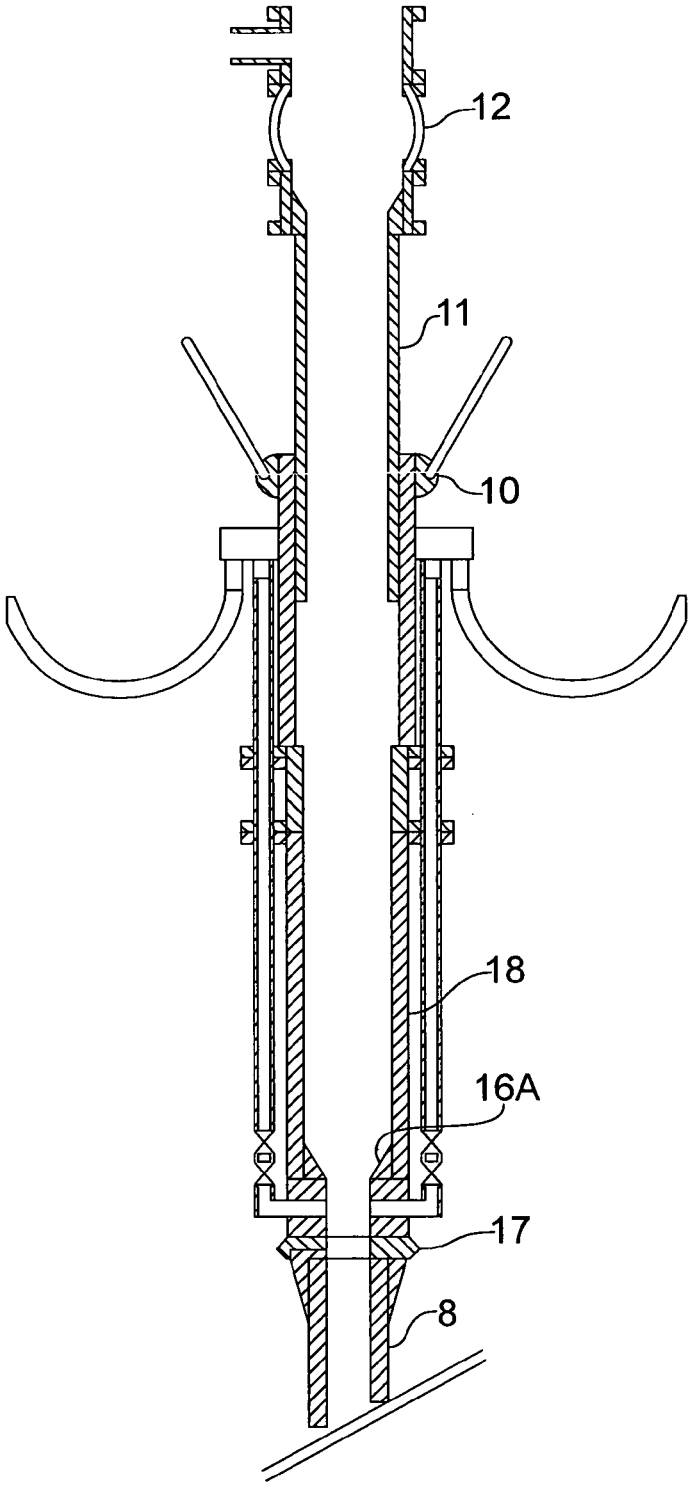
FIG. 3 shows the top of the riser without and assembly according to the invention FIGS. 4A and 4B shown different embodiments of an assembly and assembly within the top of the riser for wire line operations.

In FIG. 2 there is shown a similar system to the one in FIG. 1 in some more detail. There is indicated that the SBOP is comprised of several valve modules 20, which are configured to form a replaceable modular assembly 15. The replaceable assembly also comprises a telescopic low pressure extension module 21, which also can be a slip joint module. The assembly 15 is attached to a first interface 16A formed within a housing 18 (FIG. 3). The tension equipment is connected to the top of the housing 18 to keep the riser system tension. There are also indicated valves in the kill line 13 and the injection line 14.

Figure 4A:
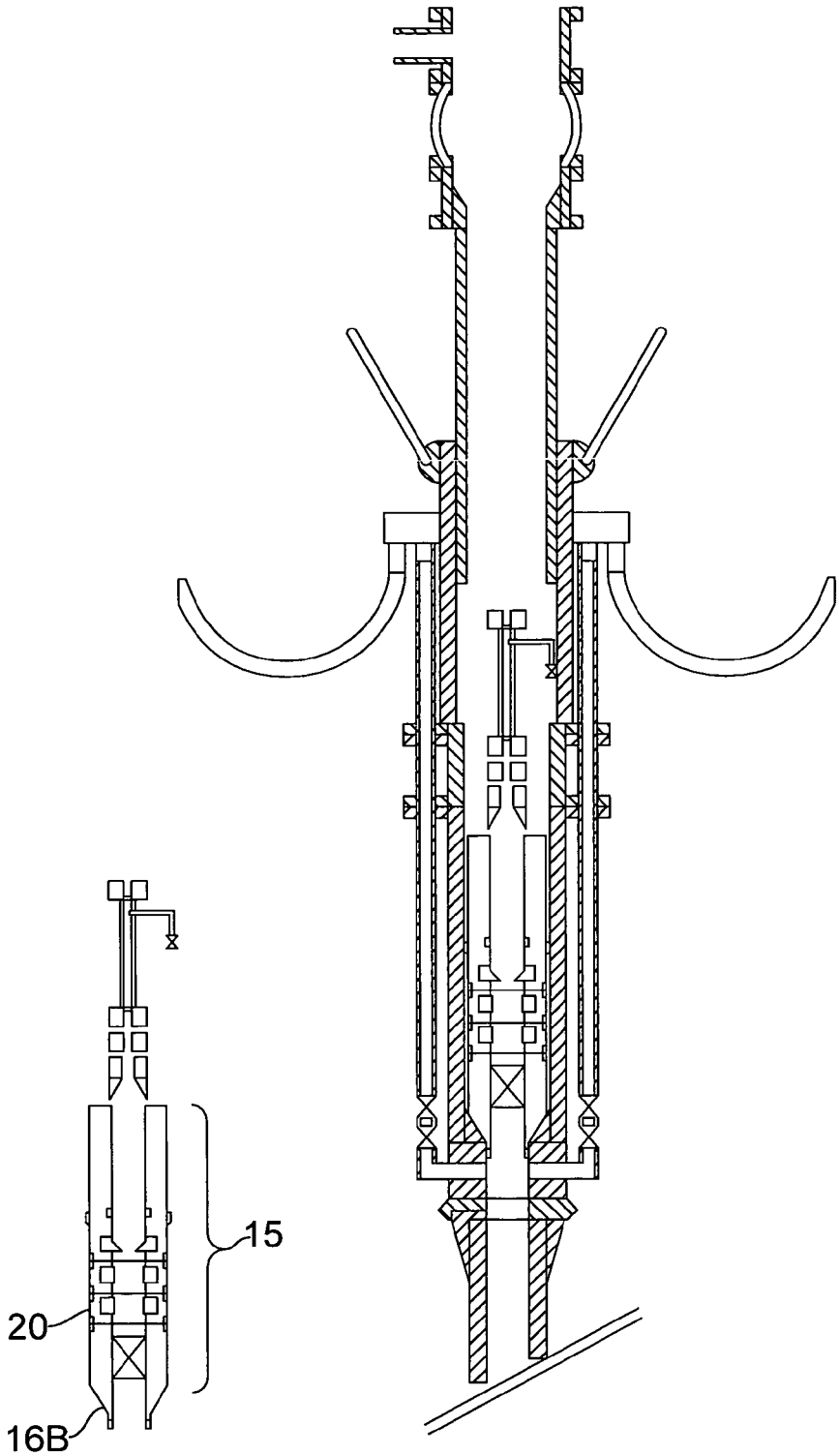
Figure 4B:
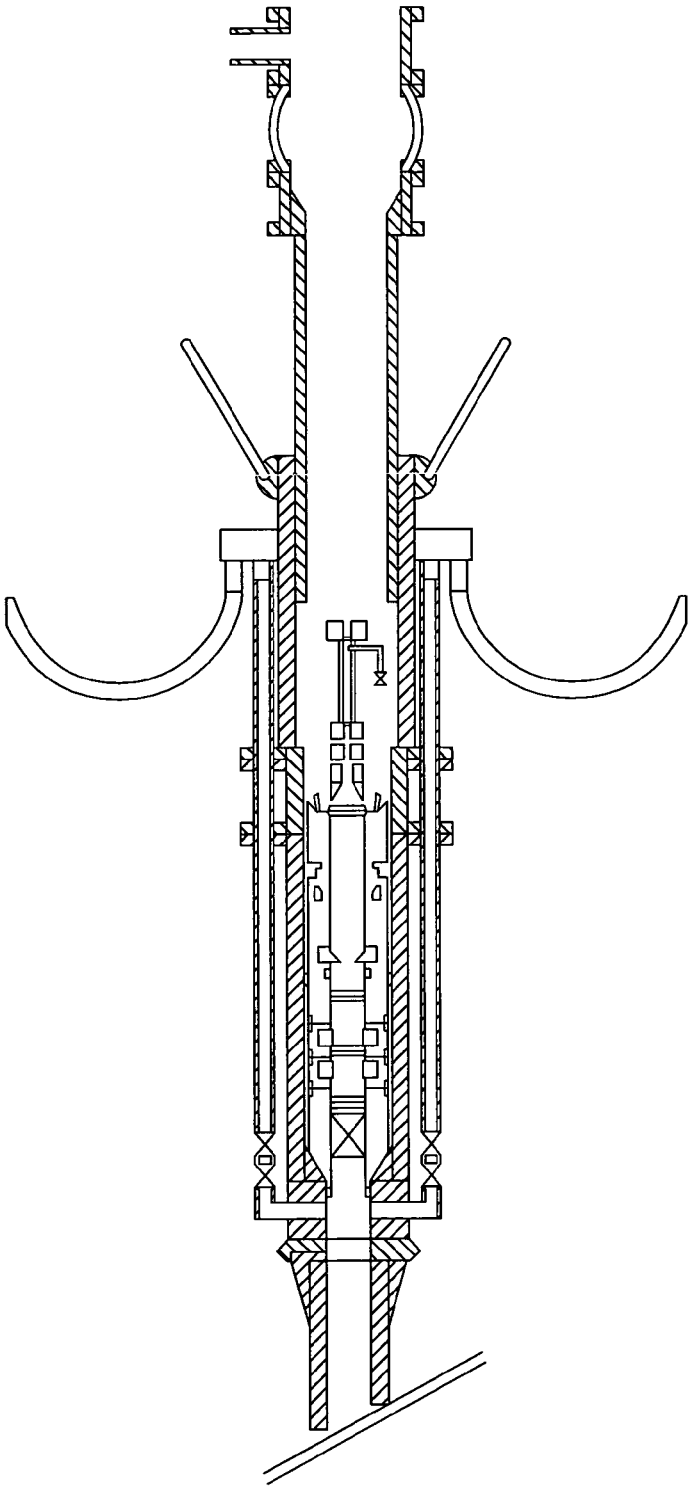

FIGS. 3, 4A and 4B show the upper part of the riser system according to the invention. The riser system comprises the high pressure riser 8, having an extension in the form of a housing 18. The housing 18 may have a connection element 17 to be disconnectable from the riser 8. The housing 18 comprises a first connection interface 16A, for attaching a replaceable assembly 15 via a second interface 16B, such that the assembly 15 is securely connected to the high pressure riser 8. As one can see from the figure the connection point 10 for the tension equipment on the floating installation is arranged at the top of the housing 18. There is also a low pressure slip joint 11 and a flex joint 12 forming the top of the riser system. The injection line and kill lines are guided on the outside of the housing 18 to a point below the connection point for the tension system.

According to the invention there may to the connection interface (16A) in the housing 18 be attached different assemblies, assembled to perform a specific operation in the well.

In FIG. 4A there is shown one such assembly, for performing wire line operations. The assembly is shown by it self on the left in the figure and attached to the connection interface on the right in the figure. In this assembly there are valve modules, shearing modules, extension modules, extension modules with valves, and a specific wire line module. In this embodiment the assembly is assembled in one piece, pressure tested at the floating installation and then connected to the connection interface within the housing. The assembly is thus positioned fully assembled within the housing.

In FIG. 4B there is shown a somewhat different configuration where the assembly comprises two subassemblies, with a first subassembly, a valve module assembly, comprising of several modules, as an extension module with valve and other valve modules. This first subassembly comprises an interface for connection to the connection interface of the housing and also an attachment interface for attaching a second subassembly to the first subassembly. The second subassembly, a tool assembly comprises also several modules with an extension module and a specific wire line tool module.

Figure 5A:
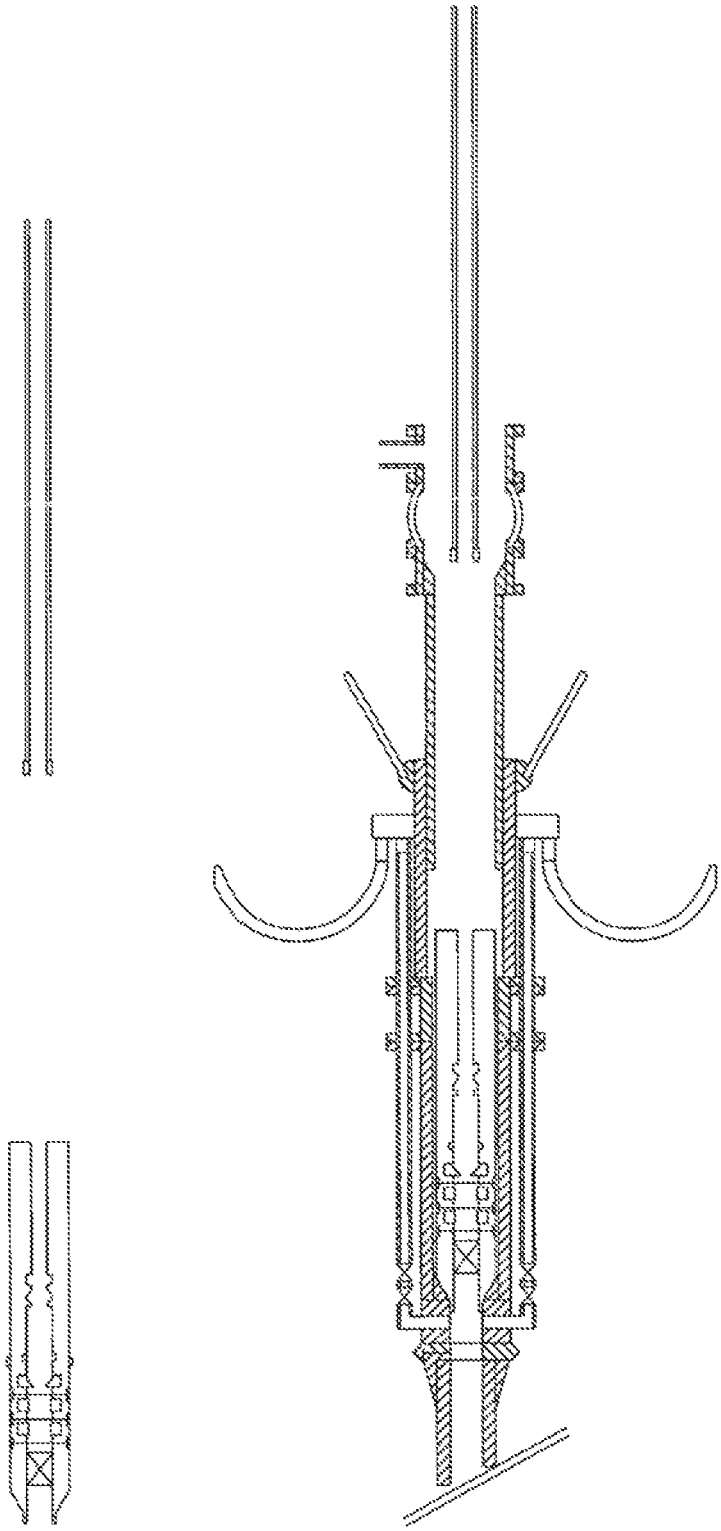
FIGS. 5A and 5B, FIG. 6 and FIG. 7 show assemblies and assemblies arranged at the top of the riser for coiled tubing operations.
Figure 5B:
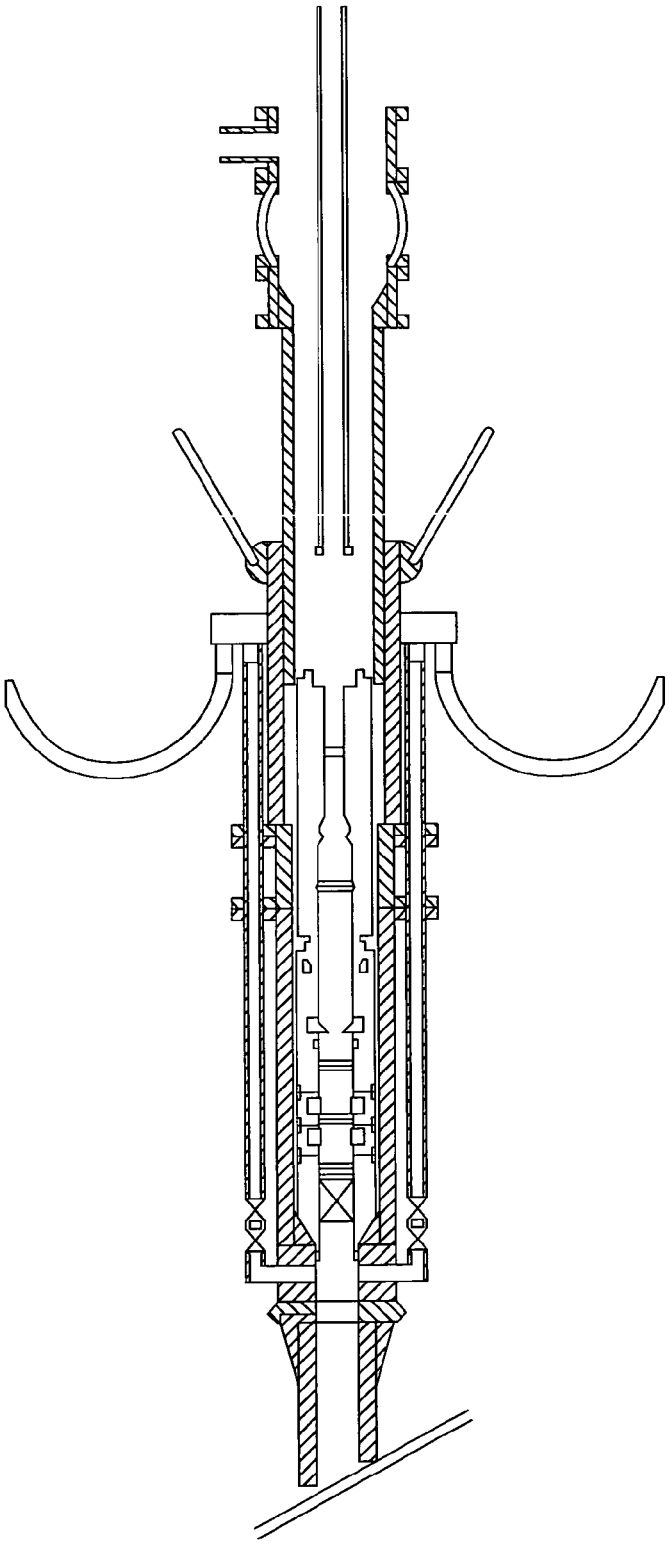
Figure 6:
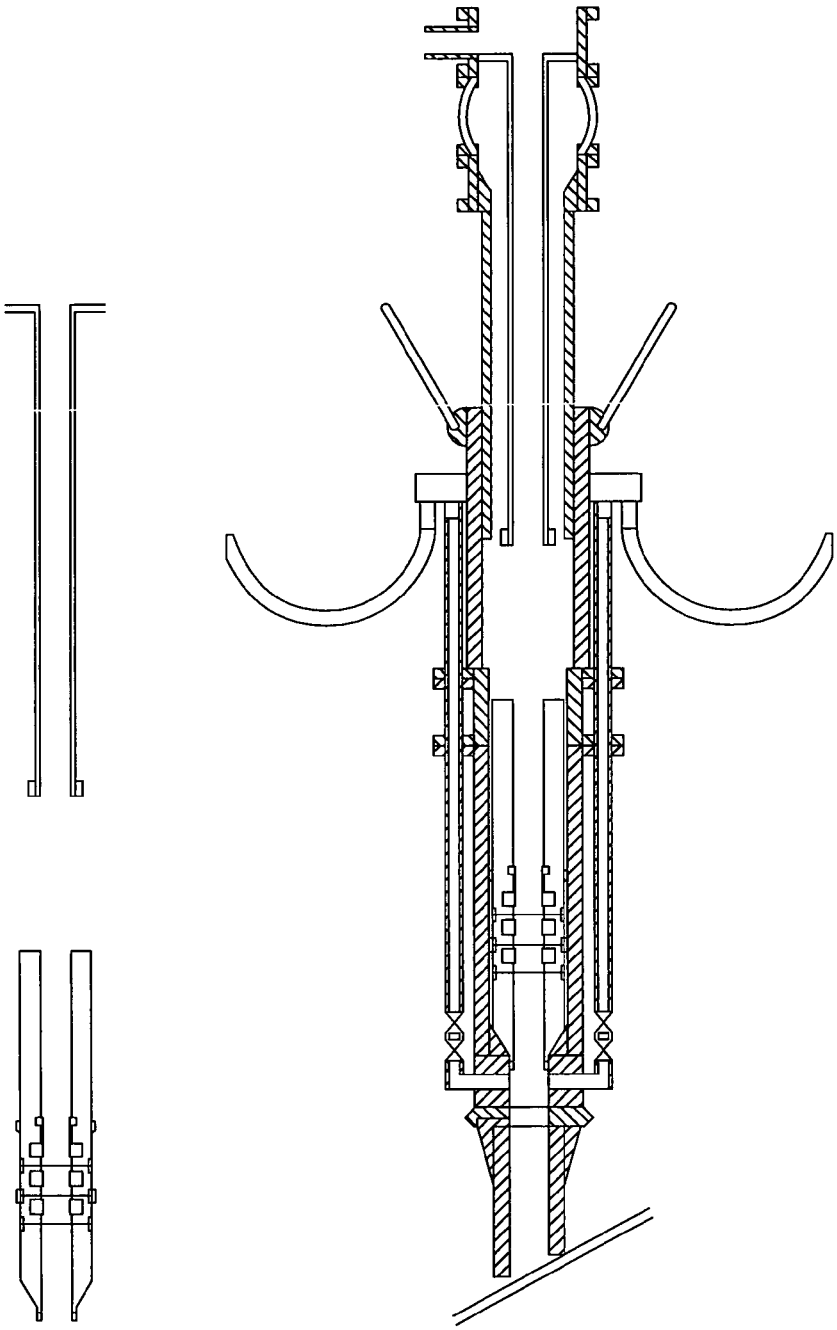
Figure 7:
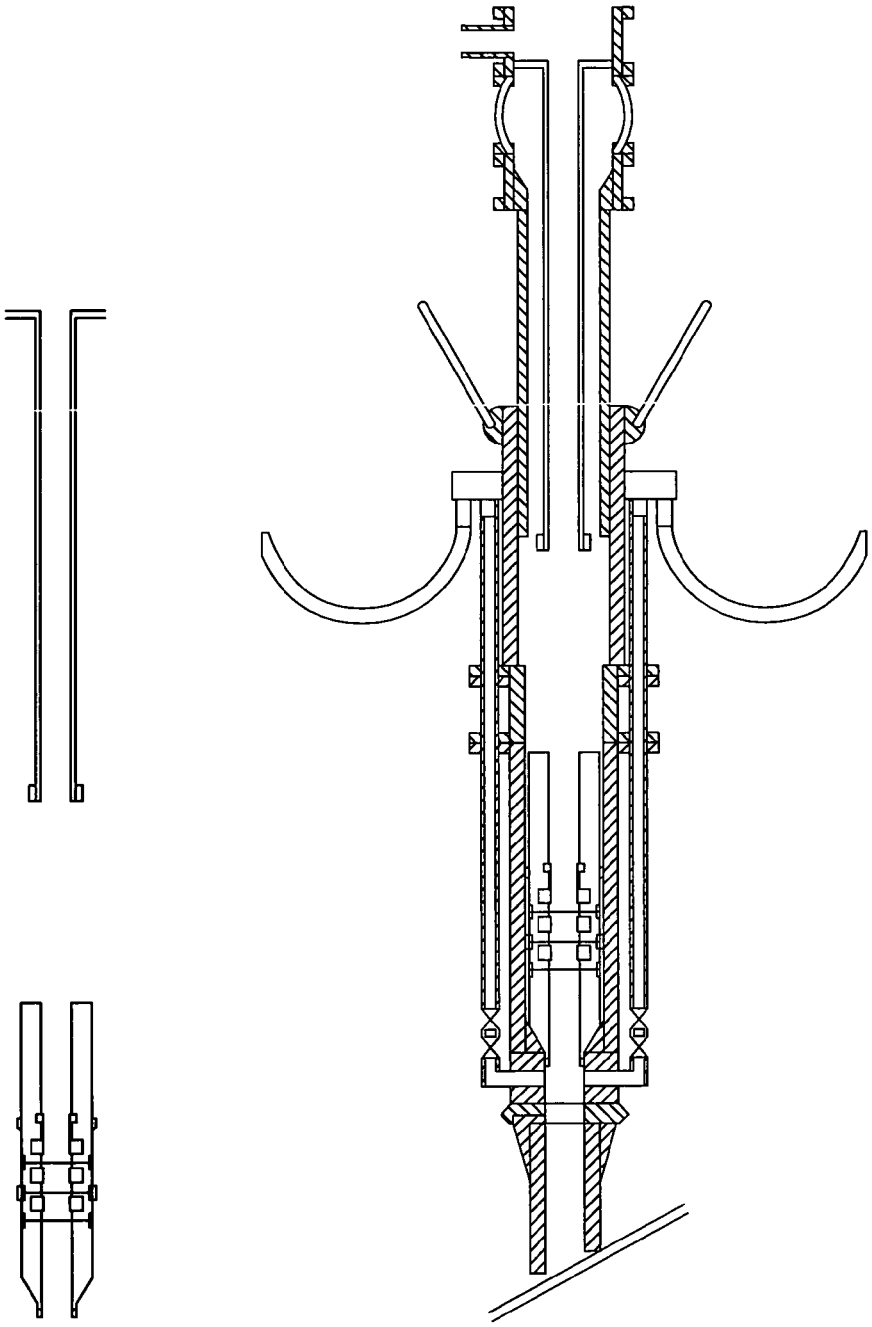
Figure 8:
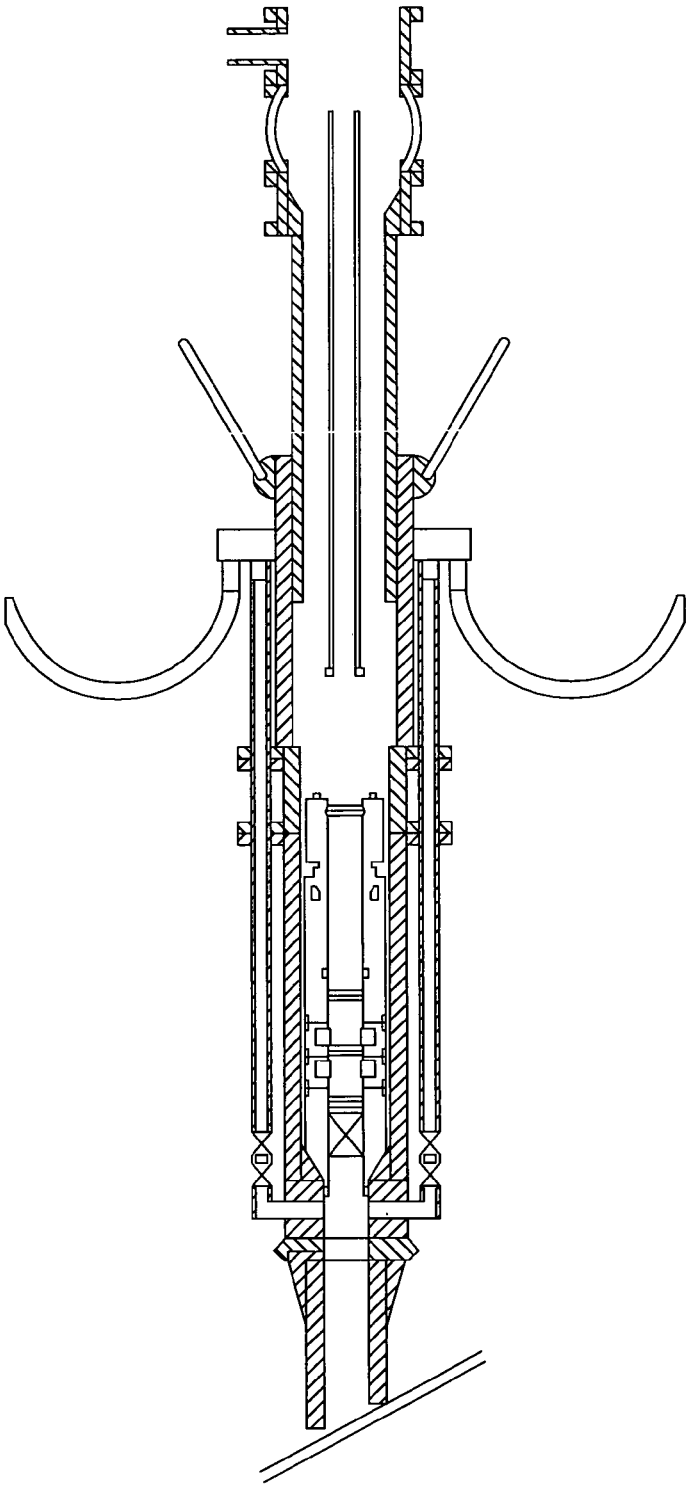
FIG. 8 shows an embodiment for drilling operations.

In FIG. 5A there is shown a similar system but in this case an assembly for coiled tubing operations, where the assembly comprises several valve modules, shearing modules, extension modules and also a slip joint module. In FIG. 5A the assembly 15 is shown as one assembly, while in FIG. 5B it is shown comprising two subassemblies. There is shown a second configuration of an assembly for of coiled tubing operations in FIG. 6, and a third configuration of an assembly for coiled tubing operations in FIG. 7. In FIG. 8 there is shown an assembly configuration for drilling operations, comprised of two subassemblies.

Figure 9:
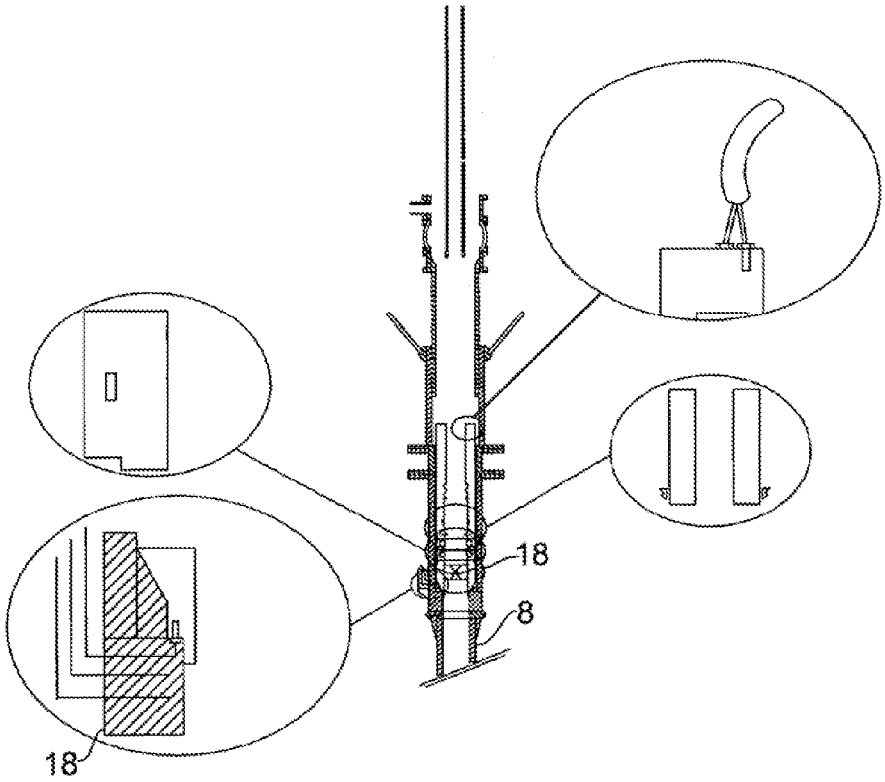
FIG. 9 shown a schematic sketch of a control, communication and power transfer in the assembly, FIG. 10 shown a detail of a hydraulic system as indicated in FIG. 9
Figure 10:
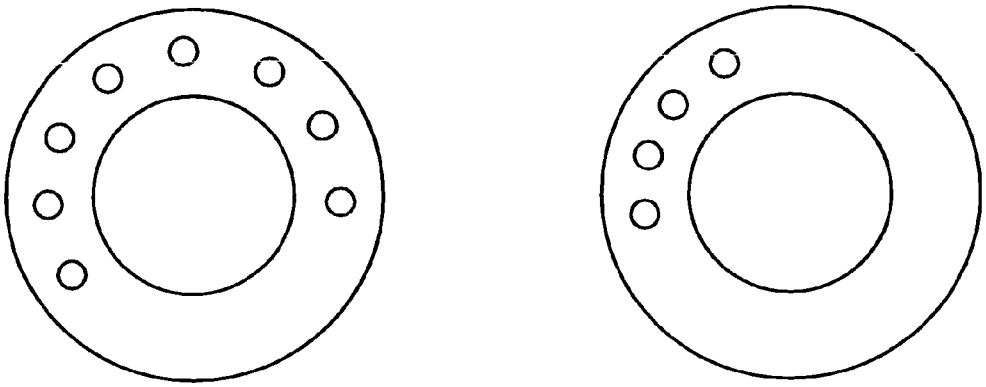

In FIG. 9 there are shown possible details on how to achieve communication between or through the different modules forming an assembly. In the embodiment shown hydraulic fluid is supplied to the modules through the housing, and the connecting interface then also comprising means for transferring hydraulic fluid, signals etc through to the assembly. As indicated in FIG. 10 there may be a number of passages in the wall of the modules for supplying hydraulic fluid to each module where some of the passages terminates (and is used) in the module while others are connected to the nest module(s) up.

Figure 11A:
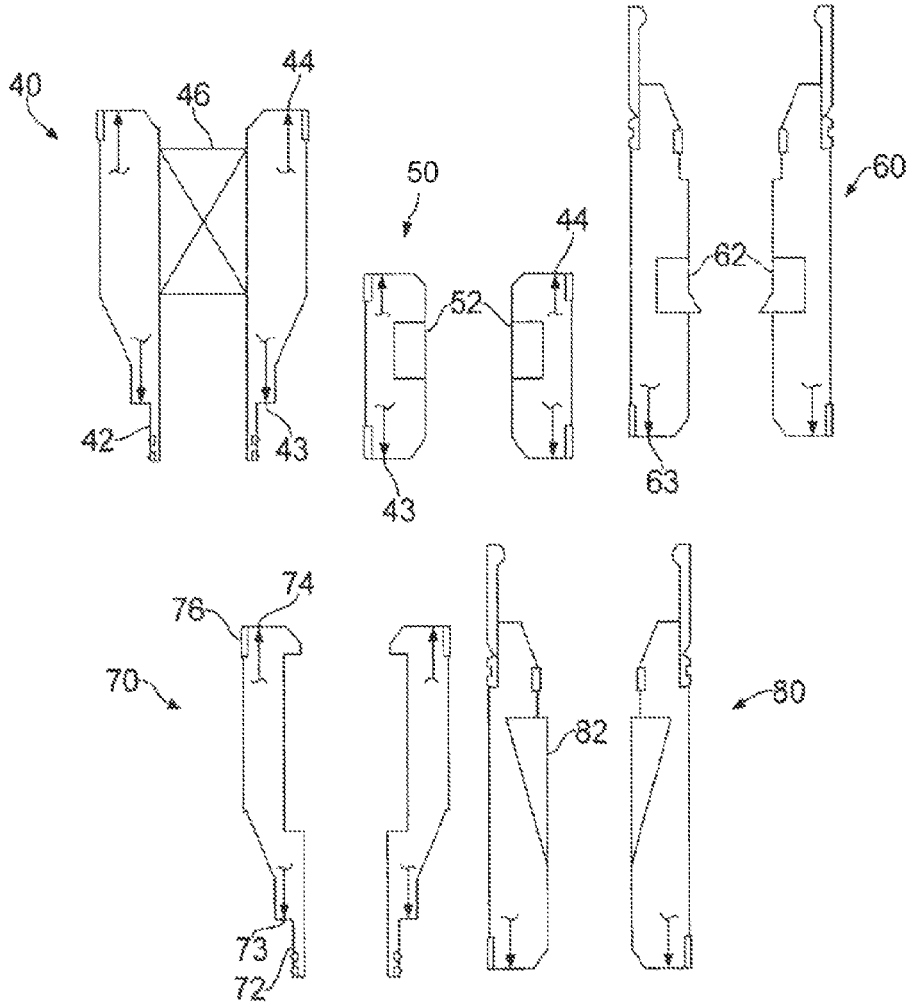
FIGS. 11A and 11B show several alternative modules for use in an assembly according to the invention.
Figure 11B:
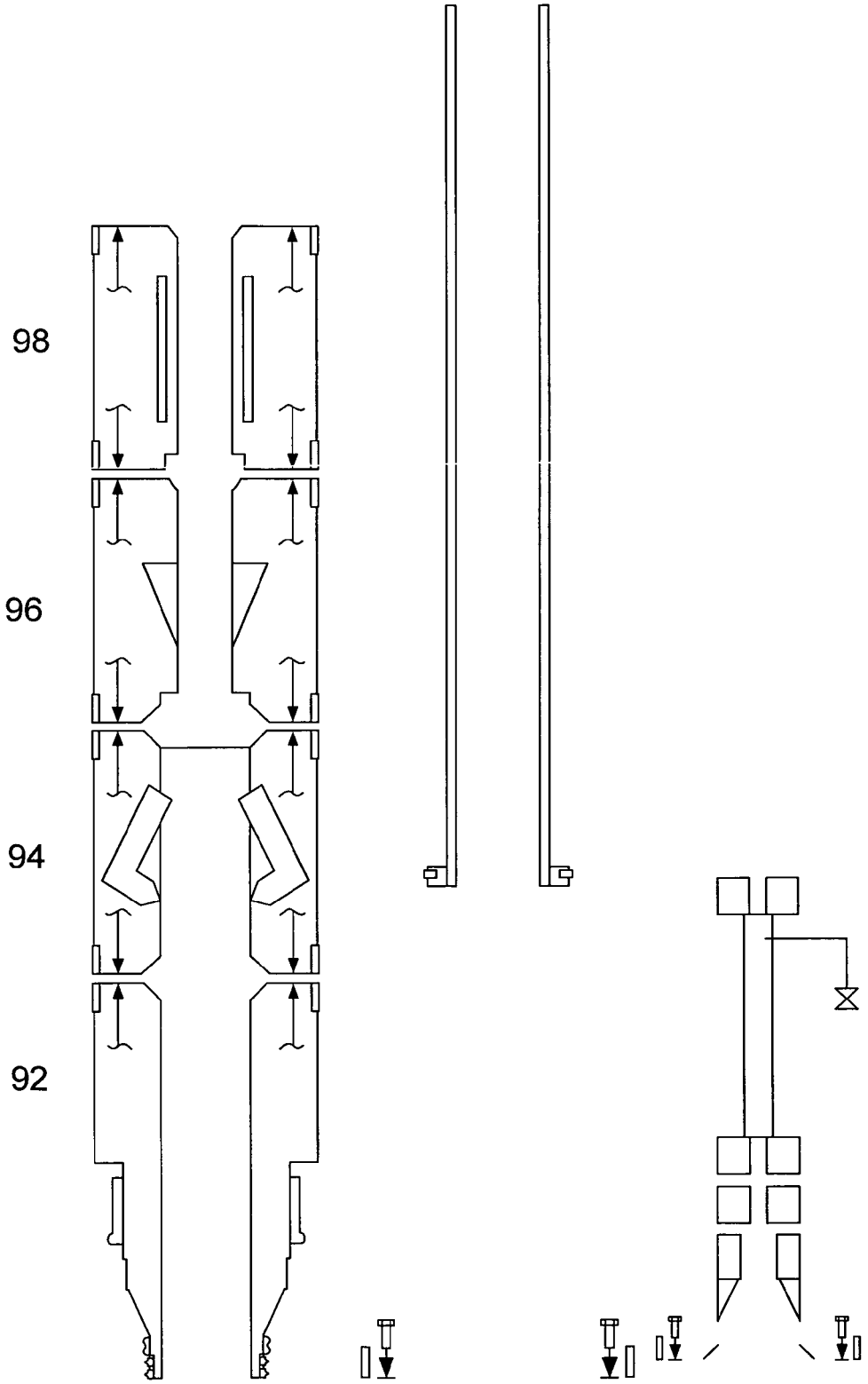

In FIG. 11A and FIG. 11B there are shown several different modules which can be connected to each other to form an assembly or possibly a subassembly. Module 70 is a latch tool module that comprises locking means 72 for locking into the lower end of the housing 18/top end of riser 8. This module may include ports 73 for the supply of hydraulic fluid to the subassembly, as shown in FIG. 9. In this embodiment, passages may run through the module and exit at ports 74 that connect to the next module to supply fluid to this module. In the ports 73 and 74 there will preferably be arranged hydraulic couplers having valves that will close the port when the modules are disconnected from each other. In this embodiment it is envisaged that the lower subassembly is locked to the housing 18 with this module. Also note that since this is the lowermost module the locking means 72 is of one type to enable it to fit into the standard interface at the lower end of the housing. The upper end of the module has locking means 76 to lock this module with the module above.

Module 50 is a pipe ram module having rams 52 that can be closed around a pipe and isolate the annular space between the pipe and the inner wall of the module. As above, the module comprises lower 43 and upper 44 ports for hydraulic fluid supply.

Module 60 is a shear ram module having knives 62 to cut through a pipe in an emergency. As this module would normally be the uppermost module in the subassembly there are only supply ports 63 and no ports to connect to a module above.

Module 40 is identical to module 70 but has been modified to include a valve 46, preferably a ball valve but it may also be any other kind of valves such as gate valve or plug valve. In certain operations it may be desirable to have a valve in the latch tool.

Module 80 is an annular bag-type valve that is used during drilling operations. The bag 82 is designed to close around a rotating drilling string to divert drilling fluids up to the rig.

In FIG. 11B there is shown elements that form the second subassembly. As can be seen in the drawing the bottom module 92 has at its lower end the same interface as the latch tool 70. As also is shown in FIG. 11A the upper module (in this case modules 60 or 80) has at its upper end the same interface as the housing interface 16A. Therefore the upper subassembly can fit either into the lower subassembly or into the housing and vice versa. Each module 92, 94, 96, 98 has identical interfaces and locking means enabling them to be stacked on top of each other in any order. Module 92 is a latch tool that helps in locking the subassembly into the housing (in reality the lower subassembly), module 94 is a tool catcher, module 96 is a coil tubing annular bag and module 98 is a dual stripper. All these elements are normal equipment in use for drilling and workover operations and as such are well known in the arts.

Figure 12:
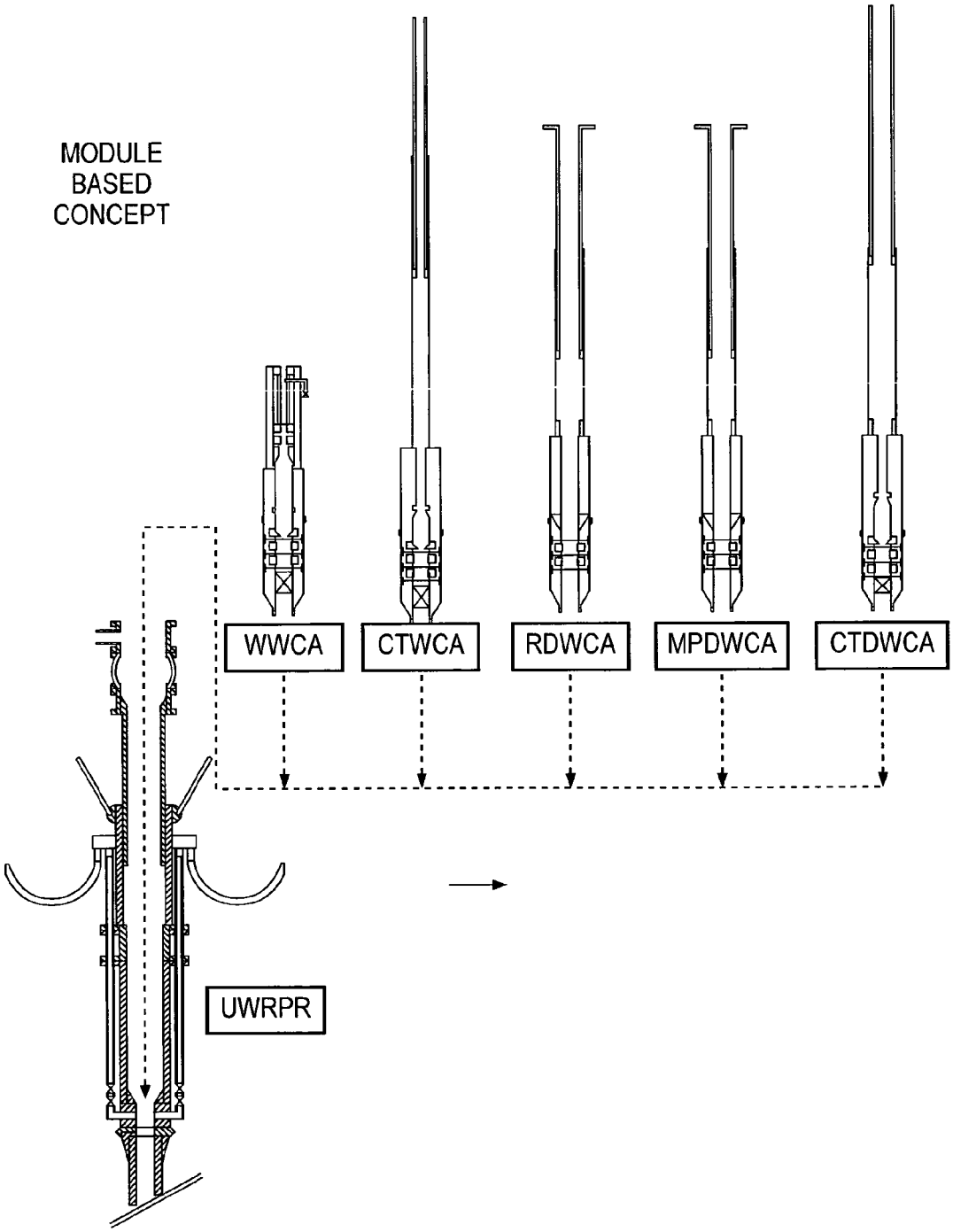
FIG. 12 shows examples of assemblies according to the invention.

FIG. 12 shows examples of subassemblies that will be assembled on the rig deck and tested before inserting the assembly into the housing to be locked there.

The invention has now been explained with reference to different embodiment, a skilled person would understand that there may be made alterations and modifications to the shown embodiments that are within the scope of the invention as defined in the attached claims.

The invention claimed is:

1. A method of performing operations in a well from a floating installation through a high pressure riser which is connected to the floating installation through a tension system at a tension connection point, the riser comprising a housing section having an internal diameter larger than an internal diameter of the riser, the housing section being located at the top of the riser and being connected to the floating installation by a low pressure riser section, and the housing section comprising a first connection interface, wherein the method comprises the steps of:

making an assembly comprising at least two connectable modules which are configured to perform a desired well operation, at least one of said modules being configured to seal off the high pressure riser at the housing section and the assembly comprising a second connection interface, assembling the assembly at the floating installation, positioning the assembly in the housing section, connecting the second connection interface in the assembly to the first connection interface in the housing section, and performing the desired operation in the well by the use of the assembly.

2. The method according to claim 1, wherein the method comprises pressure testing the assembly at the floating installation before positioning the assembly in the housing section.

3. A method of performing operations in a well from a floating installation through a high pressure riser which is connected to the floating installation through a tension system at a tension connection point, the riser comprising a housing section with an internal diameter larger than an internal diameter of the riser and being connected at the to of the riser, and the housing section being formed with a first connection interface, wherein the method comprises the steps of:

making an assembly comprising a number of connectable modules which are configured to perform a desired well operation, the assembly comprising a second connection interface, assembling the assembly at the floating installation, positioning the assembly in the housing section, connecting the second connection interface in the assembly to the first connection interface in the housing section, and performing the desired operation in the well by the use of the assembly, wherein the assembly is made up of two subassemblies which each comprise at least two modules, and wherein the method comprises positioning each subassembly separately in the housing section.

4. A riser system for performing a desired operation in a well, comprising:

a high pressure riser extending from a subsea installation toward a floating installation and being connected to the floating installation through a tension system at a tension connection point, a housing section forming part of said riser, said housing section being located at the top of said riser and being connected to the floating installation by a low pressure riser section, the housing section comprising a first connection interface, an assembly comprising at least two connectable modules and a second connection interface for connection with the first connection interface, at least one of said modules being configured to seal off the high pressure riser at the housing section, wherein the assembly is configured, by the chosen modules, to perform the desired operation in the well.

5. The riser system according to claim 4, wherein an internal diameter of the housing section is larger than an internal diameter of the riser and is adapted to encompass at least a part of the assembly.

6. The riser system according to claim 4, further comprising equipment for assemblage of the assembly at the floating installation and a system for pressure testing the assembly before connecting it to the housing section.

7. The riser system according to claim 4, further comprising lifting equipment at the floating installation for moving the assembly between a deck at the floating installation and the housing section.

8. A riser system for performing a desired operation in a well, comprising:

a high pressure riser extending from a subsea installation toward a floating installation and being connected to the floating installation through a tensions stem at a tension connection point, a housing section forming part of said riser and being located at the top of said riser, the housing section comprising a first connection interface, an assembly comprising a number of connectable modules and a second connection interface for connection with the first connection interface, said assembly comprising:

a first subassembly comprising at least one modular element, an interface for cooperation with the first connection interface and a first attachment interface, and a second subassembly for performing the operation in the well, the second subassembly comprising a second attachment interface for cooperation with the first attachment interface of the first subassembly.

9. The riser system according to claim 8, wherein the first subassembly is a replaceable valve module assembly and the second subassembly is a replaceable tool assembly.

* * * * *